United States Patent [19]

Williams

[11] Patent Number: 4,770,275

[45] Date of Patent: Sep. 13, 1988

[54] LEVELLER FOR LADDERS AND OTHER APPARATUS

[76] Inventor: Patrick Y. Williams, 22 Compass Way, Tweed Heads, New South Wales 2485, Australia

[21] Appl. No.: 18,944

[22] PCT Filed: May 29, 1986

[86] PCT No.: PCT/AU86/00155

§ 371 Date: Jan. 29, 1987

§ 102(e) Date: Jan: 29, 1987

[87] PCT Pub. No.: WO86/07113

PCT Pub. Date: Dec. 4, 1986

[30] Foreign Application Priority Data

May 29, 1985 [AU] Australia ..... PH0794

[51] Int. Cl.[4] ..... E06C 7/44

[52] U.S. Cl. ..... 182/202; 248/188.3

[58] Field of Search ..... 182/202; 248/188.3

[56] References Cited

U.S. PATENT DOCUMENTS

| | | | |
|---|---|---|---|
| 2,289,499 | 7/1942 | Husted | 182/202 |
| 2,330,825 | 10/1943 | Hoit | 182/202 |
| 2,366,829 | 1/1945 | Biery | 182/202 |
| 2,854,180 | 9/1958 | Brunckhorst | 182/202 |
| 2,890,824 | 6/1959 | Derby | 182/202 |
| 2,969,126 | 1/1961 | Gardner | 182/202 |
| 3,173,512 | 3/1965 | Sturdy | 182/202 |
| 3,258,085 | 6/1966 | McCarty | 182/202 |
| 3,954,241 | 5/1976 | Carlson | 248/188.3 |
| 4,095,671 | 6/1978 | Forristal | 182/202 |
| 4,673,061 | 6/1987 | Zeiset | 182/202 |

*Primary Examiner*—Reinaldo P. Machado

*Attorney, Agent, or Firm*—Fulwider, Patton, Rieber, Lee & Utecht

[57] ABSTRACT

A leveller for a ladder has a pair of sliding legs telescopically engagable in respective up-right tubes (which may constitute the stiles of the ladder or separate tubes to be fixed to the stile of a ladder), and a substantially uniform continuous flexible ligament such as a wire rope fixed to upper regions of the legs and extending between the tubes and engaging with a support guide means which is fixed relative to the ladder structure or relative to the other apparatus on which the levelling device is mounted. When loaded, the ladder transmits its load through the support guide means to tension the ligament but when the load is removed (for example by subsidence of the ground beneath one of the legs) tension is released from the ligament allowing it to slide over the support guide means to cause rapid readjustment of the relative vertical positions of the ladder to compensate for variations in ground level, whereby the ladder is maintained in its desired attitude.

9 Claims, 4 Drawing Sheets

LEVELLER FOR LADDERS AND OTHER APPARATUS

This invention relates to a levelling apparatus comprising adjustable support legs and in one particular form can be detachably mounted to a ladder to compensate for variations in the surface on which the support legs are to rest. In another form, the apparatus can be incorporated in a ladder.

To overcome problems arising from uneven terrain, ladders have been equipped with slidably adjustable telescopic legs which can be fixed in a selected position by a locking screw so as to compensate for differences in level between the two legs supporting the ladder. This arrangement, however, is cumbersome to use and difficult to adjust. Other previously published levelling devices are disclosed in the following patent specifications:

DE.A. 2327053 (ZARGES) Dec. 12, 1974
U.S. Pat. No. 2,289,499 (HUSTED) Jul. 14, 1942
U.S. Pat. No. 1,551,395 (HUSTED) Aug. 25, 1925
GB.A. 1369365 (STRUM) Oct. 9, 1974
AU.B. 60183/73 (483196) TEST SOCIETE ANONYME D'ETUDES TECHNIQUES Mar. 13, 1975

With use of embodiments of the present invention, ladder legs can adjust rapidly for changes caused by subsidence or instability of the ground on which the ladder rests and this can take place safely with a user at the top of the ladder; furthermore, the invention permits adjustment of the ladder without the necessity of locking and unlocking the legs manually.

According to the present invention, there is provided a levelling apparatus for a structure comprising:

(i) substantially rigid, support guide means adapted to be fixed relative to the structure;

(ii) an elongated, flexible ligament arranged to extend along the support guide means and to be moveable therealong,;

(iii) a plurality of elongated leg guides;

(iv) support legs displaceably mounted in the respective leg guides and connected to the ends of the elongated ligament such that corresponding displacement of the support legs occurs during adjustment for levelling purposes, and during normal use the load of the structure is transmitted through the support guide means to the elongated ligament, which is thereby placed under tension and transmits the load to the support legs and characterised by (v) the ligament being of substantially uniform continuous form along at least the portion arranged for engaging the support guide means whereby there is provided stepless adjustment of the legs and automatic adjustment to compensate for ground subsidence at one leg relative to the other.

Preferably, the support guide means has an elongated ligament engagement surface over which the ligament moves during adjustment of the legs and against which the ligament frictionially engages when under constant load, a portion of said engagement surface intermediate the legs being arranged at a higher level than end portions of the support guide means located nearer the legs.

In a preferred embodiment, the intermediate portion of the support guide means is a smoothly curved member, for example a shallow inverted V-shaped member having a groove for accommodating the ligament.

The end portions of the support guide means preferably comprise smoothly curved guide elements fixed adjacent the legs for guiding the ligament through a turn of about 90°. The guide elements could be grooved wheels (providing frictional surfaces for the ligament are used elsewhere in the support guide means) or grooved blocks e.g. of plastics material.

Preferably, the elongated ligament is constrained so as to be guided in a respective channels between the co-operating support legs and the respective leg guides.

The elongated ligament can be selected from a range of different materials, but in a preferred embodiment comprises a wire rope.

Preferably, the intermediate portion of the support guide means has a surface texture to facilitate frictional engagement with the ligament. In a preferred embodiment, the ligament is a wire rope and the surface of the guide means has a series of ribs and grooves corresponding to the profile to the wire rope.

One aspect of the invention consists in a ladder incorporating a levelling device, for example by utilising lower portions of the stiles of the ladder as the leg guides. This application is especially beneficial when the ladder is a steel or aluminum ladder formed from tubular material. In the case of an aluminum ladder, the components can readily be extruded with a desired complex shape, but where steel is utilised, preferably the invention is implemented by using simple tubular shapes such as rectangular tube.

Another aspect of the invention consists in apparatus suitable for attachment to a ladder, in which case the elongated leg guides are adapted to be secured by suitable fixing means, such as U-bolts, to the stiles of the ladder.

Such an attachment apparatus in one embodiment is of the form shown in FIGS. 1 to 6 of the accompanying drawings and described hereinafter as a ladder incorporating a ladder levelling device. In the case of the attachment apparatus for a ladder, the tubular stiles 1 shown in the drawings instead of being utilized as part of the ladder are utilized as tubular stiles of the attachment apparatus and have a convenient length. These stiles are attached by U-bolts to the stiles of a ladder itself.

In a preferred embodiment of the invention, the support guide means is arranged to be rigidly fixed to a rung or step of a ladder and the load is transmitted by virtue of this connection.

It has been found, surprisingly, that with at least a preferred embodiment of the invention, the ladder can be manufactured in a durable and convenient form and may be safely used without the necessity of any additional locking device. More particularly, it has been found that when one of the support legs moves, for example by sinking into soft sand, the ladder leveller very rapidly re-adjusts with no loss of stability even when carrying a heavy load. It is thought that this occurs due to release of the tensioning forces in the ligament in the region above the leg which is sinking, thereby removing the resistance to movement normally experienced in the ligament and the greater force applied upwardly to the opposite end of the ligament translates into a displacement force. This force moves the ligament along its axial direction and along the support guide means. However where the forces are equalised, the ligament is pressed against the support guide means and the levelling device remains in a substantially fixed configuration. An embodiment of the invention will now be described by way of example, with reference to the accompanying drawings of which:

Figure 1:
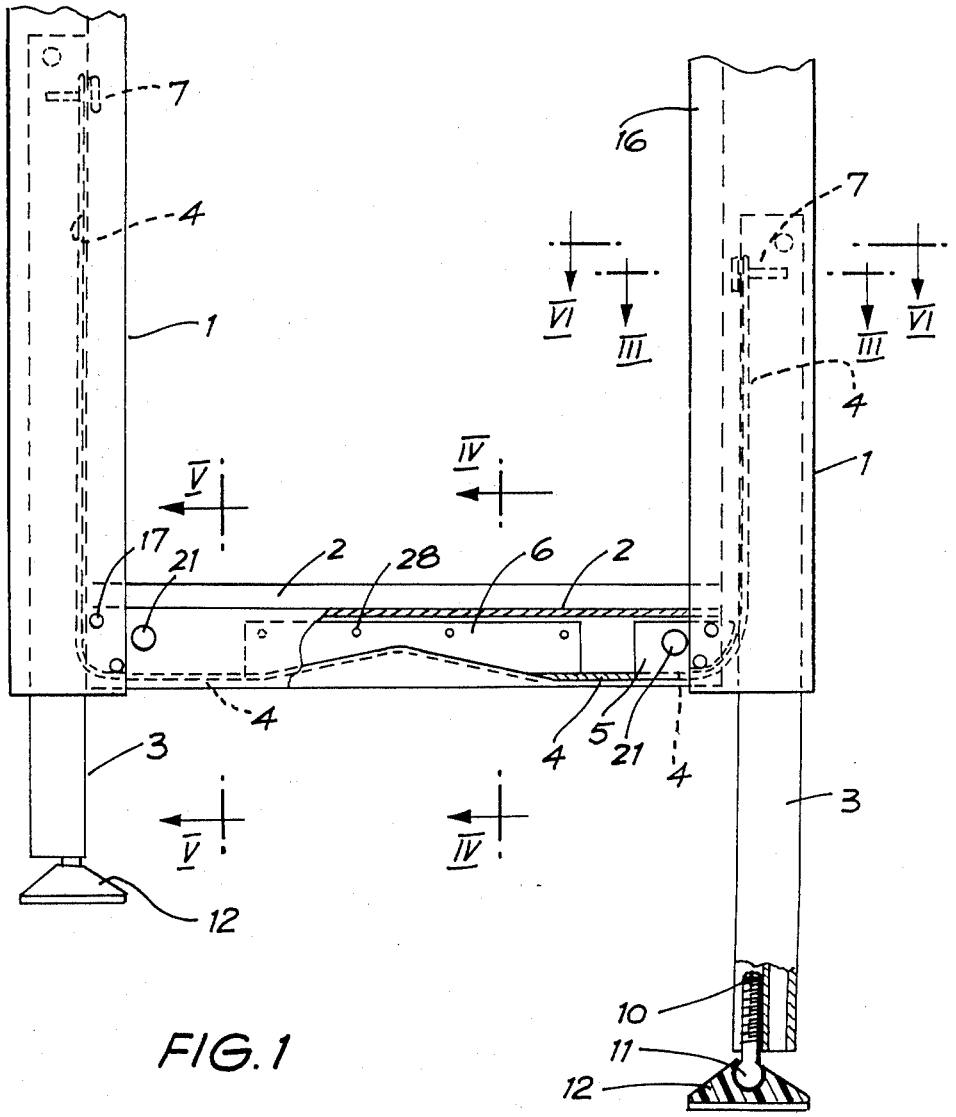
FIG. 1 is a front view of a ladder incorporating a levelling apparatus taken from the left of FIG. 1.
Figure 2:
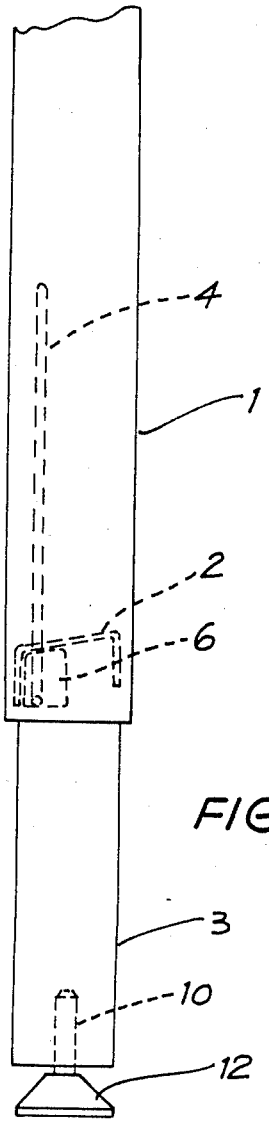
FIG. 2 is a side view from the right.

The ladder shown in the drawings incorporates a ladder leveller device in its bottom region. The ladder comprises a pair of tubular stiles (1) rigidly interconnected by generally inverted U-shaped rungs (2) with telescopic tubular legs (3) being arranged to co-operate with the lower portion of the stiles (1). A flexible wire rope (4) interconnects the legs (3) by being secured thereto by fixing screws (7) as described below with reference to FIG. 6. The wire rope (4) passes over grooved plastic guide blocks (5) located at the junction of the stiles (1) and lower rung (2), the wire rope passing over a central convex guide unit (6) fixed below the rung (2) and acting to support the wire at along a path which extends to a higher elevation than the lowest point of the wire as it passes over the respective guide blocks (5).

In normal use the weight carried by the ladder is transmitted through the stiles to the lower rung (2) and through the guide blocks (5) onto the wire which is tensioned across the convex support unit (6). The static friction generated has been found to maintain the ladder safely in its selected position of adjustment.

If the ladder legs are to be adjusted to cope with uneven ground or a set of steps, the ladder is simply placed on the ground so that one leg engages the ground, the weight of the ladder thereby pushing that leg up so that the wire is pulled through from the opposite side thereby permitting the opposite leg to lower until the loads are equalized and the ladder is upright.

Similarly if the ground below one leg subsides, there is a lack of equalization of load, tension is removed from the wire rope(4) and readjustment automatically takes place very speedily; it has been found that the ladder is quite safe even with a heavy person at the top of the ladder.

Details of the embodiment will now be described.

Figure 3:
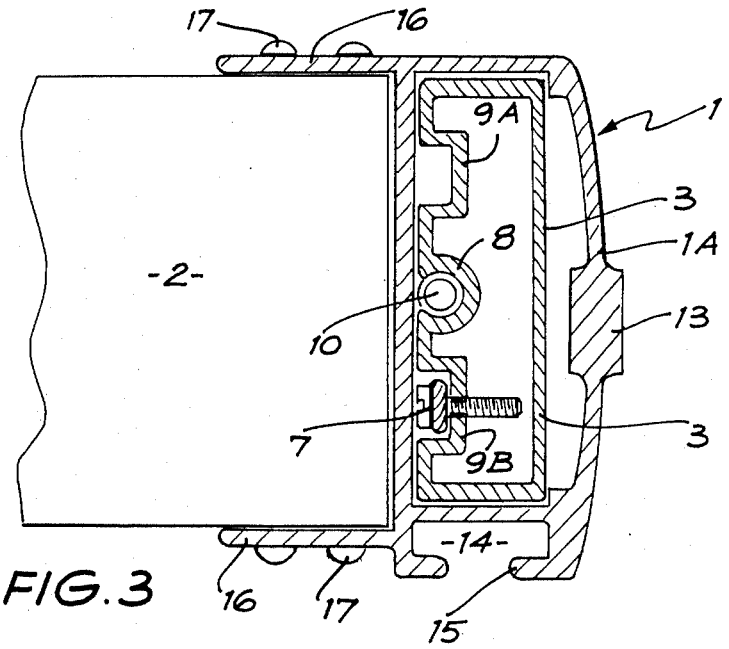
FIG. 3 is a cross-sectional plan view through the right hand ladder leg taken along the line III—III of FIG. 1.

Each of the sliding legs (3) is tubular and of generally rectangular cross-sectional shape, as best shown in FIG. 3, and has one of the longer sides interrupted by a central part-circular groove (8) and rectangular lateral grooves (9A) and (9B). Either of the grooves (9A) or (9B) could accommodate the wire rope (4) which terminates at its upper end in an eyelet through which the fixing screw (7) passes. The screw (7) is a self-tapping screw which passes through a bored hole in the bottom of the groove which accommodates the wire. FIG. 3 shows the right hand ladder leg and it will be noted that in this embodiment the wire rope is arranged in the groove towards the front of the ladder unit. The left hand ladder leg will use groove (9A) for accommodating the wire rope (4). The tube (3) is a aluminum extrusion and is a clearance fit within an outer aluminum extrusion forming the ladder leg (1).

At the lower end, each of the ladder legs (3) is fixed to a foot unit comprising a screw-threaded fixing bolt (10) which screw threadably engages in the part-circular groove (8), the bolt having a spherical head (11) which is a press fitted into a corresponding cavity in a generally conical moulded rubber foot (12) which can pivot about the head (11) to adjust to the surface on which the ladder rests.

Referring now to FIG. 3, detail of the ladder leg extrusion (1) is shown in detail. The extrusion has a generally rectangular cavity for accommodating the leg (3) but has an outer convex wall (1A) incorporating a thickened section (13) which apart from providing strength is capable of receiving a threaded bore at any convenient location for a locking screw. The locking screw simply permits the leg (3) to be clamped in a selected position should this be desired for any particular purpose or application.

At its edge which in use is the forward edge the stile, the extrusion has an undercut rectangular cavity (14) with turned-in lips (15) provided such that an extension ladder can be formed by the use of another similar extrusion with its corresponding cavity adjacent to the cavity illustrated; an H-shaped connection strip is used for coupling together the two members. The strip is a clearance or sliding fit in one cavity and an interference fit in the other cavity. The extrusion further comprises side flanges (16) between which the U-shaped ladder rungs (2) are engaged, vertical legs (2A) of the ladder rungs being secured to the flanges (16) by pairs of rivets (17).

Figure 6:
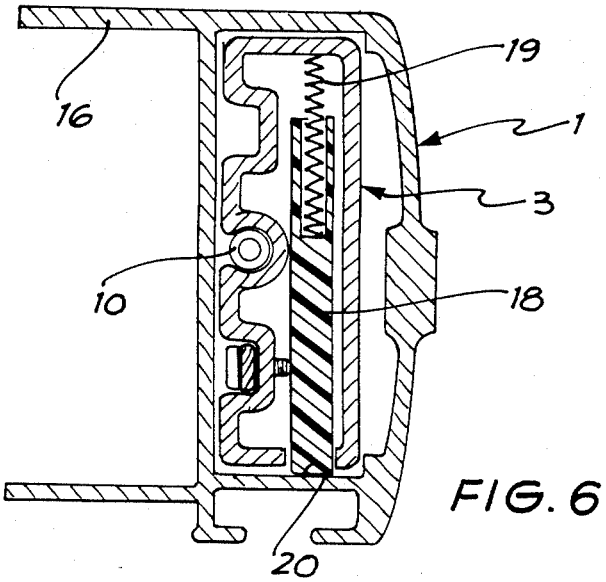
FIG. 6 is a sectional plan view taken along the line VI—VI of FIG. 1.

Referring now to FIG. 6, a leg retaining device is shown, the device comprising a cylindrical moulded plastic pin (18) having a bore in its inner end and accommodating the end of a helical compression spring (19). The spring urges against the rear upright wall of the leg (3) to urge the tip (20) of the pin (18) outwardly through a clearance aperture in the front wall of leg (3) and against the interior of the confronting wall of the ladder stile (11). Thus a braking effect is provided and the spring (19) has sufficient tension to prevent the leg falling under gravity when the entire ladder is lifted off the ground. One the other hand, the tension is such that the weight of the ladder alone overcomes the braking effect to permit adjustment of the legs to suit the ground profile.

Figure 4:
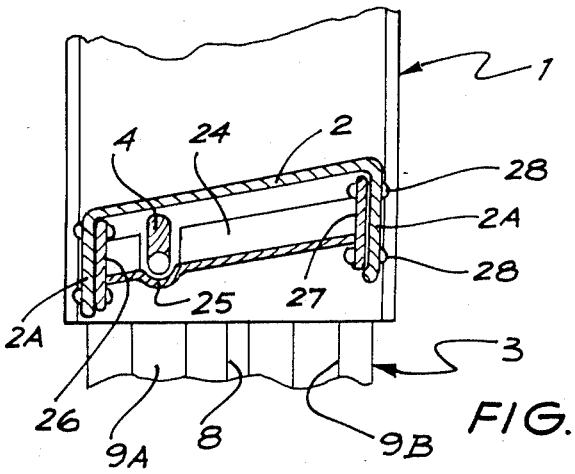
FIG. 4 is a cross-sectional side elevation taken along the line IV—IV of FIG. 1.
Figure 5:
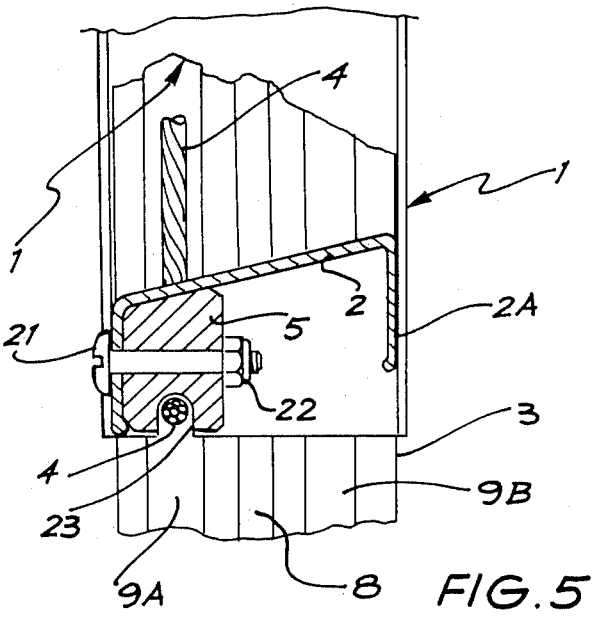
FIG. 5 is a cross-sectional side elevation taken on the line V—V of FIG. 1.

The manner in which the wire rope (4) is guided between the ladder legs will be described with reference to FIGS. 5 and 4. Referring first to FIG. 5, a sectional elevation looking towards the left hand ladder leg is shown.

The plastic block (5) is secured beneath the ladder rung (2) by a screw (21) and nut (22), the groove (23) extending along the lower edge region of the block, around a part-circular curved end region and vertically upwardly along its rear face so as to accommodate the wire rope (4).

In the central region of the rung (2), the guide unit (6) has a generally V-shaped ramp (24) having a groove (25) for accommodating the wire rope (4) and upstanding front and rear flanges (26) and (27) which are pop rivetted by rivets (28) to the front and rear legs of the ladder rung (2).

Levelling devices embodying this invention permit essentially automatic levelling of the ladder in a speedy and reliable manner. Construction can be relatively simple and inexpensive. Furthermore, the device can be formed from inexpensively extruded components having a high degree of accuracy, ensuring free movement of the slidable support legs. Minimal additional height of a ladder can be achieved and only a relatively small additional weight is incorporated into a ladder in preferred embodiments.

Although the device has immediately obvious applications to a ladder, it is no way restricted to ladders alone, as the device can be used with equally advantageous results when adapted to tressels, step-ladders and other structures.

The claims defining the invention are as follows:

I claim:

1. A levelling apparatus for a structure comprising:

(i) a substantially rigid, support guide means adapted to be fixed relative to the structure;

(ii) an elongated flexible ligament arranged to extend along the support guide means and to be moveable therealong;

(iii) two elongated leg guides;

(iv) support legs displaceably mounted in the leg guides and connected to the ends of the elongated ligament such that corresponding displacement of the support legs occurs during adjustment for levelling purposes, and during normal use the load of the structure is transmitted through the support guide means to the elongated ligament which is under tension and transmits the load to the support legs;

(v) the ligament being of substantially uniform continuous form along at least the portion arranged for engaging the support guide means whereby there is provided stepless adjustment of the legs and automatic adjustment to compensate for ground subsidence at one leg relative to the other and the improvement comprising (vi) the support guide means having an elongated ligament engagement surface over which the ligament moves during adjustment of the legs and against which the ligament frictionally engages when under constant load, a portion of said engagement surface intermediate the legs being arranged at a higher level than end portions of the support guide means located nearer the legs.

2. A levelling apparatus as claimed in claim 1 and wherein the intermediate portion of the support guide means is a smoothly curved member.

3. A levelling apparatus as claimed in claim 2 wherein the curved member is of shallow inverted "V" shape form with a groove extending thereover for accommodating the ligament.

4. A levelling apparatus as claimed in claim 1 wherein the intermediate portion of the support guide means is adapted to be mounted on a lower rung of a ladder which is to be levelled by use of the apparatus.

5. A levelling apparatus as claimed in claim 1, and wherein the end portions of the support guide means comprise smoothly curved guide elements fixed adjacent said legs for guiding the ligament through a turn of about 90°.

6. A levelling device as claimed in claim 1, wherein guide means for the elongated element are provided between the co-operating support legs and the respective leg guides.

7. A levelling device as claimed in claim 1 and wherein the intermediate portion of the support guide means has a grooved profile for accommodating the ligament, and a texturing of the grooved profile corresponding to a texturing of the ligament surface.

8. A levelling device as claim in claim 1 wherein the elongated ligament comprises a wire rope.

9. A levelling apparatus as claim in claim 1, and dimensioned and constructed such that the elongaged leg guides are adapted to be secured to the stiles of a ladder and the support guide means is adapted to be fixed to a rung of the ladder.

* * * * *